US009581118B2

(12) United States Patent
McAlister

(10) Patent No.: US 9,581,118 B2
(45) Date of Patent: Feb. 28, 2017

(54) INJECTOR-IGNITERS WITH VARIABLE GAP ELECTRODE

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 14/508,796

(22) Filed: Oct. 7, 2014

(65) Prior Publication Data

US 2016/0208756 A1 Jul. 21, 2016

Related U.S. Application Data

(63) Continuation of application No. 13/830,270, filed on Mar. 14, 2013, now Pat. No. 8,851,047.

(60) Provisional application No. 61/682,750, filed on Aug. 13, 2012.

(51) Int. Cl.

| | |
|---|---|
| ***F02M 57/06*** | (2006.01) |
| ***H01T 13/26*** | (2006.01) |
| ***H01T 13/24*** | (2006.01) |
| ***F02D 37/02*** | (2006.01) |
| ***F02P 5/04*** | (2006.01) |

(52) U.S. Cl.

CPC ..... *F02M 57/06* (2013.01); *F02D 37/02* (2013.01); *F02P 5/045* (2013.01); *H01T 13/24* (2013.01)

(58) Field of Classification Search

CPC ..... F02M 57/06; F02D 37/02; F02P 5/045; H01T 13/24

See application file for complete search history.

(56) References Cited

U.S. PATENT DOCUMENTS

| | | | | |
|---|---|---|---|---|
| 2,459,286 A * | 1/1949 | Wiegand | F02M 57/06 | 137/542 |
| 4,095,580 A * | 6/1978 | Murray | F02M 57/06 | 123/297 |
| 5,531,199 A * | 7/1996 | Bryant | F02B 3/02 | 123/297 |
| 6,586,865 B1 * | 7/2003 | Tamai | H01T 13/26 | 313/125 |
| 6,712,033 B2 * | 3/2004 | Marforio | H01T 13/26 | 123/158 |
| 6,748,918 B2 * | 6/2004 | Rieger | F02M 51/0671 | 123/297 |

(Continued)

FOREIGN PATENT DOCUMENTS

GB 172069 A * 12/1921 ..... H01T 13/24

*Primary Examiner* — Mahmoud Gimie
*Assistant Examiner* — David Hamaoui
(74) *Attorney, Agent, or Firm* — Perkins Coie LLP

(57) ABSTRACT

Fuel injector-igniters with variable gap electrodes. A fuel injector-igniter comprises a housing, an actuator disposed in the housing, and a valve including a valve head operative to open and close against a valve seat in response to activation of the actuator. A valve seat electrode including at least one aperture surrounds the valve head and valve seat and at least one rocker electrode is pivotably mounted to the housing to form a variable gap between the electrode and a portion of the valve seat electrode. The rocker electrode is positioned to move relative to the valve seat electrode in response to a fuel flow through the aperture, thereby varying the gap.

20 Claims, 9 Drawing Sheets

(56) References Cited

U.S. PATENT DOCUMENTS 6,755,175 B1 * 6/2004 McKay ..... F02M 51/0671 123/297
6,814,313 B2 * 11/2004 Petrone ..... F02M 51/0671 239/584
6,832,588 B2 * 12/2004 Herden ..... F02M 61/14 123/193.1
6,871,630 B2 * 3/2005 Herden ..... F02M 61/14 123/267
6,955,154 B1 * 10/2005 Douglas ..... F02M 57/06 123/297
7,077,100 B2 * 7/2006 Vogel ..... H01T 13/22 123/297
7,086,376 B2 * 8/2006 McKay ..... F02M 57/06 123/297
8,069,836 B2 * 12/2011 Ehresman ..... F02M 57/06 123/151
8,074,625 B2 * 12/2011 McAlister ..... F02M 51/0671 123/472
8,225,768 B2 * 7/2012 McAlister ..... F02M 51/0671 123/297
8,311,723 B2 * 11/2012 McAlister ..... F02B 3/06 123/297
8,365,700 B2 * 2/2013 McAlister ..... F02D 35/021 123/297
8,528,519 B2 * 9/2013 McAlister ..... F02M 57/06 123/297
8,635,985 B2 * 1/2014 McAlister ..... F02M 57/005 123/297
8,746,197 B2 * 6/2014 McAlister ..... F02M 57/06 123/143 B
8,800,527 B2 * 8/2014 McAlister ..... F02M 57/06 123/297
8,851,047 B2 * 10/2014 McAlister ..... F02M 57/06 123/169 EA
2004/0149256 A1 * 8/2004 Dye ..... F02M 27/04 123/297

* cited by examiner

INJECTOR-IGNITERS WITH VARIABLE GAP ELECTRODE

CROSS-REFERENCE TO RELATED APPLICATION

The present application is a continuation of U.S. patent application Ser. No. 13/830,270, filed Mar. 14, 2013, which claims the benefit of U.S. Provisional Patent Application No. 61/682,750, filed Aug. 13, 2012, the disclosures of which are hereby incorporated by reference in their entireties.

BACKGROUND

Stratified-charge, compression ignited diesel engines can provide considerably higher thermal efficiency than spark-plug ignited homogenous-charge combustion engines but require fuels with high cetane rating to provide ignition by air that has been sufficiently preheated by rapid compression. Combustion chamber compression ratios of 16:1 to 22:1 are typically required for compression ignition systems of engines designed to use diesel fuel with an appropriate cetane rating. There is great interest in using alternative and/or renewable fuels interchangeably with diesel fuel in existing engines to reduce fuel costs and reduce exhaust emissions compared to diesel fuel.

However, long standing problems have defeated numerous attempts to use spark ignition in high compression engines. Such problems include: failure of narrow spark gaps to reliably ignite fuel-air mixtures at high compression pressures; failure of inductive coil voltage boosting ignition systems due to inadequate containment and delivery of the voltage required for spark production in highly compressed air; and failure of capacitance discharge systems due to failure to contain the voltage required for spark production in highly compressed air.

In many cases, these failures are the result of voltage containment failures of materials such as engineering polymers and spark plug porcelain that have provided satisfactory voltage containment for combustion chambers of relatively low compression engines. Other failures include capacitive dissipation, conduction and arc-propagation, along with cracking, spalling, and phase changes of conventional materials due to the high voltage magnitudes required in high-compression engines.

Accordingly, there are urgent needs for improved ignition and/or fuel system components that have the capability to provide an adequate spark discharge at electrode gaps of 1 mm (preferably greater) and for cylinder pressures of 700 PSIG and greater in order to facilitate applications of alternative and/or renewable fuels interchangeably with diesel fuel in existing engines.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various view unless otherwise specified.

DETAILED DESCRIPTION

Figure 1:
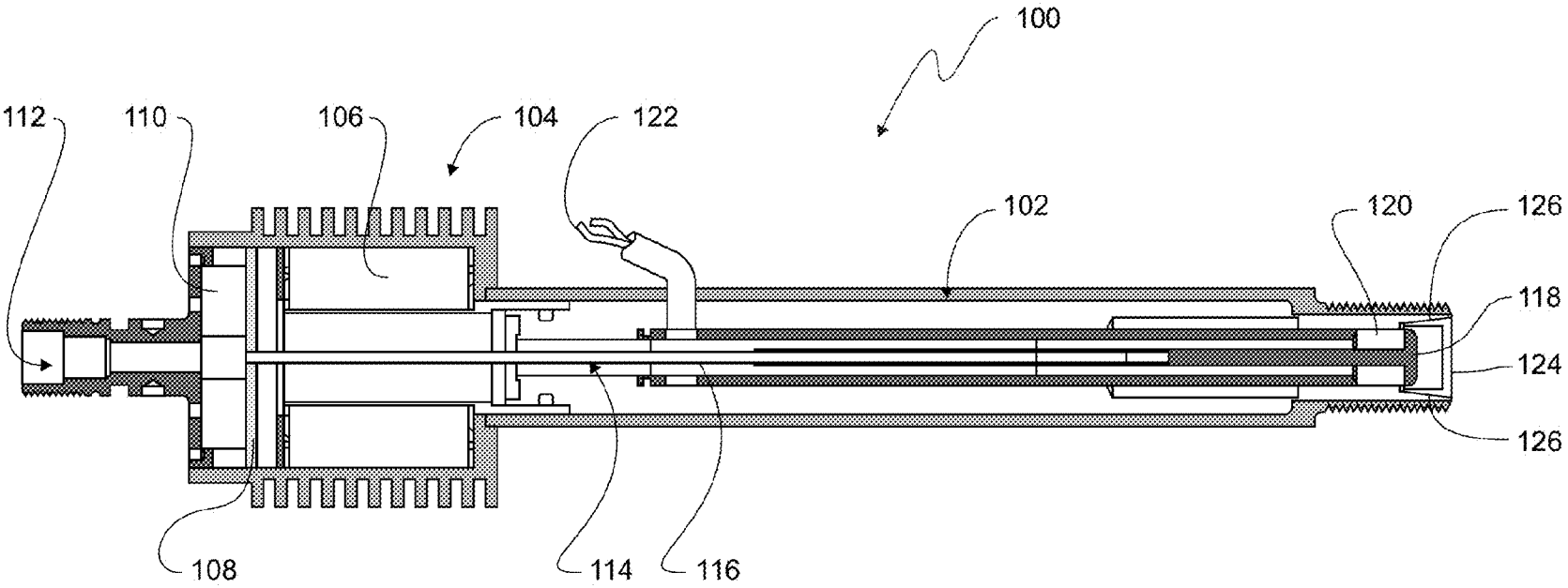
FIG. 1 is a partial cross-sectional side view of an injector-igniter according to a representative embodiment incorporating variable gap electrodes.

The present technology provides one or more fuel injections along with one or more spark ignition events and is capable of providing high voltage containment and spark and/or continuing arc generation at spark gaps that are articulated between 0 and 3 mm, for example, and can do so at combustion chamber pressures exceeding 2000 PSIG. In operation, the disclosed injector-igniters provide spark ignition and complete combustion of multiple fuel injections even with unfavorable cetane ratings in combustion chambers at 1000 PSIG or greater pressure, for example.

The representative embodiments disclosed herein, include fuel injector-igniters having one or more electrodes that are moveable thereby forming a variable gap between the electrode and a portion of the housing. For example, the injector-igniters may include one or more reed electrodes that extend from an electrode cage or a valve head to form a gap between the reed electrode and the injector housing. The reed electrodes are moved by spring, magnetic, fuel flow, and/or combustion forces, for example, in order to vary the gap between the reed electrode(s) and housing electrode components.

Provided herein are fuel injector-igniters with variable gap electrodes. In an embodiment, a fuel injector-igniter comprises a housing and an actuator disposed in the housing. A valve including a valve head is operative to open and close against a valve seat in response to activation of the actuator. At least one movable electrode forms a variable gap between the electrode and a portion of the housing. In one embodiment, the movable electrode extends from the valve head and a fuel flow past the valve head is operative to deflect the moveable electrode, thereby varying the gap. In other embodiments, the moveable electrode is supported in the housing relative to the valve head and movement of the valve head causes the electrode to move, thereby varying the gap.

In another embodiment, a fuel injector-igniter comprises a housing, an actuator disposed in the housing, and a valve including a valve head operative to open and close against a valve seat in response to activation by the actuator. An electrode cage surrounds the valve head and includes at least one aperture. At least one spring or reed electrode extends from the electrode cage to form a gap between the reed electrode and the housing. The valve head includes a magnet, such as a permanent magnet, wherein the magnet is operative to move the reed electrode toward or away from the electrode cage or to another electrode surface when the valve head opens, thereby increasing or decreasing the spark or ignition arc gap.

In one aspect of the present technology described herein, a proximal end portion of the reed electrode is attached to the electrode cage. In other aspects of the present technology, the distal end portion of the reed electrode is biased toward a portion of the housing which serves as the opposing electrode. In some embodiments, the reed electrode comprises spring steel or another ferromagnetic material. In other embodiments, the reed electrode is pivotably supported on the electrode cage.

In another representative embodiment, a fuel injector-igniter comprises a housing, an actuator disposed in the housing, and a valve including a valve head operative to open and close against a valve seat in response to operative activation by the actuator. An electrode cage surrounds the valve head and includes a plurality of apertures. A plurality of reed electrodes, extends from the electrode cage to form gaps between the reed electrode and housing electrode. Each reed electrode is positioned over a corresponding aperture and is operative to cover the aperture and experience opening thrust by fluid pressure gradient expressed on the exposed aperture and/or reed area and closure thrust as fluid flow is diminished, during a combustion event, and/or due to the pressure gradient from the combustion chamber. The valve head includes a magnet, wherein the magnet is operative to move the reed electrodes toward the electrode cage when the valve head opens, thereby increasing the gaps compared to the initially smaller gap including certain application instances that initially provide very close proximity or contact of the electrodes and then produce larger gaps as the reed electrodes are moved or cyclically articulated away from the housing electrode.

In a further representative embodiment, a fuel injector-igniter comprises a housing, an actuator disposed in the housing, and a valve including a valve head operative to open and close against a valve seat in response to activation of the actuator. At least one flexible reed electrode extends from the valve head to form a gap between the reed electrode and the housing. Fuel flow past the valve head at least partially flows through the gap and is operative to deflect the reed electrode, thereby adjusting the gap to larger or smaller electrode spacing from another electrode.

In certain aspects of the present technology, the reed electrode is attached to the valve head. In other aspects of the technology, the injector-igniter further comprises a plurality of flexible reed electrodes attached to the valve head, wherein a distal end portion of the reed electrode is biased toward the housing.

Specific details of several embodiments of the technology are described below with reference to FIGS. 1-9B. Other details describing well-known structures and systems often associated with ignition systems, fuel systems, and electronic valve actuation, such as fuel pumps, regulators, and the like, have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-9B.

Some aspects of the technology described below may take the form of or make use of computer-executable instructions, including routines executed by a programmable computer. Those skilled in the relevant art will appreciate that aspects of the technology can be practiced on computer systems other than those described below. Aspects of the technology can be embodied in a special-purpose computer or data processor, such as an engine control unit (ECU), engine control module (ECM), fuel system controller, ignition controller, or the like, that is specifically programmed, configured or constructed to perform one or more computer-executable instructions consistent with the technology described below. Accordingly, the term "computer," "processor," or "controller" as may be used herein refers to any data processor and can include analog processors, ECUs, ECMs, and modules, as well as Internet appliances and handheld devices (including diagnostic devices, palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, or dedicated display device or mechanism (e.g., gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

FIG. 1 illustrates an injector-igniter 100 according to a representative embodiment that provides fuel injection capabilities as well as ignition capabilities. Injector-igniter 100 includes an injector housing 102 with an actuator 104 disposed therein. In this embodiment, a suitable actuator 104 comprises a piezoelectric, magnetostrictive, hydraulic, pneumatic, or solenoid assembly 106 which acts on armature 108 to open and close valve head 118 on valve 114. Valve 114 includes a valve stem 116 and a valve head 118 disposed thereon. In this case, valve 114 opens outwardly with respect to valve seat 120. The armature 108 and valve 114 are returned to a closed position with a spring and/or return magnet 110. In this embodiment, return magnet 110 is a permanent magnet, however, an electromagnet may be used in place of permanent magnet 110. Furthermore, a suitable spring may be used to return the valve to the closed position. Fuel inlet 112 receives and supplies fuel to seat 120 against which valve head 118 closes. Accordingly, valve head 118 is operative to open and close against valve seat 120 in response to activation of actuator 104 to provide fuel past valve head 118 and through and/or around electrode cage 124. Electrode cage 124 surrounds valve head 118 and provides support for a plurality of moveable electrodes in the form of reed electrodes 126. Cable 122 supplies voltage to the reed electrodes 126 to provide ion stimulation and ignition as explained more fully below with respect to FIGS. 3A and 3B.

Figure 2:
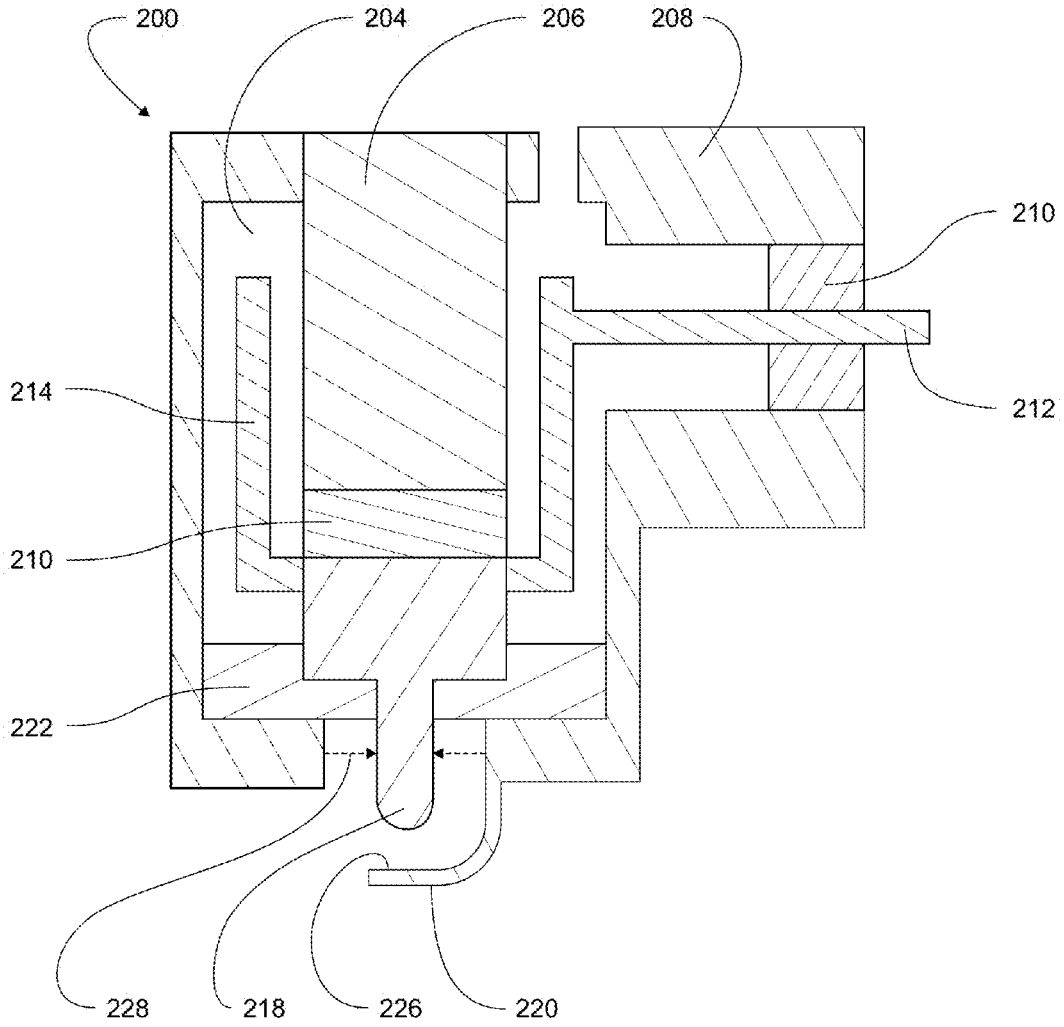
FIG. 2 is a schematic cross-sectional representation of an ignition device according to a representative embodiment.

FIG. 2 shows an ignition device 200 according to a representative embodiment that illustrates some of the advantages of a variable gap electrode. Conductor 214 is connected and charged to the voltage of conductor 212 by a suitable power supply (not shown). Bi-directional motion of actuator assembly 206, insulator 210, and conductive component 218 provides for reducing or increasing the gap distance between electrode 220 and component 218. Varying the gap from surface 226 to conductive component 218 enables control of spark discharge at 226 or 228 as desired. The electrode gap 218/226 is varied from a minimum value at the start of plasma generation to overcome a high resistance circumstance and as the resistance is reduced by the generation of additional conductive ions, the electrode gap is increased to a maximum value to reduce the maximum voltage containment requirements for different fuel types and compression chamber pressures along with different types of engine operations and emission control regimes. By initially starting with minimal electrode gaps and opening to more than 2.0 mm, for example, as the ion population increases, the voltage containment requirement can be less than, for example, 12 kV in 500 to 1000 PSIG combustion chambers. In other words, at the start of ignition, the electrode gap 218/226 is small to facilitate initiation of plasma generation with low voltage. As plasma generation develops, the gap can be increased, while reducing or maintaining a relatively low voltage.

Ignition device 200 may also use a fluid dielectric 204 that helps contain voltage developed between conductive components 208 and 212. Solid dielectric 210 provides insulation between conductor 208 and 212 and may also provide containment and/or storage of conforming dielectric fluid 204 and/or crack repair agents as shown in co-pending U.S. patent application Ser. No. 13/797,776, entitled "FLUID INSULATED INJECTOR-IGNITER," and filed on Mar. 12, 2013, the disclosure of which is incorporated herein by reference in its entirety. Solid insulative material 210 may be an organic polymer, glass, or ceramic material. In certain embodiments suitable passageways are provided to allow flow of dielectric fluid 204 into the zone in gap 228 and/or to 226 as a result of valve motion by conductor 218.

Figure 3B:
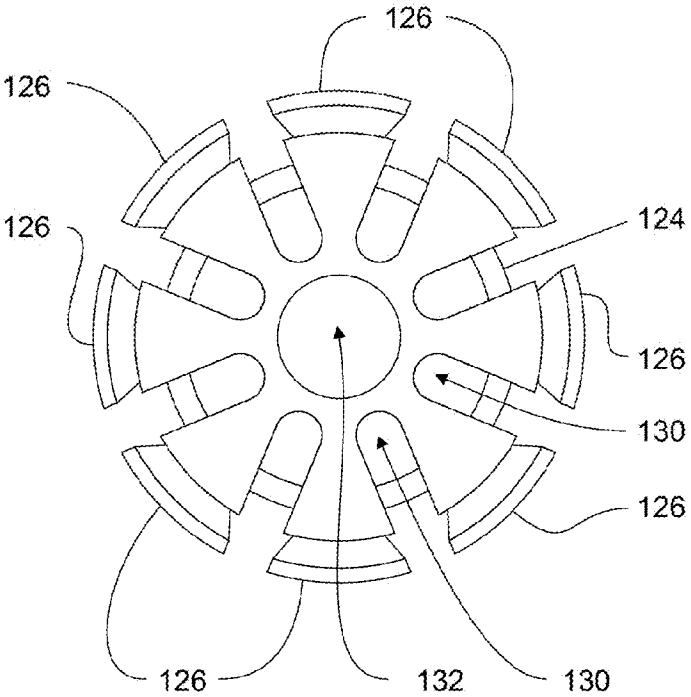
FIG. 3B is an end view of the electrode cage and reed electrodes shown in FIG. 3A.
Figure 3A:
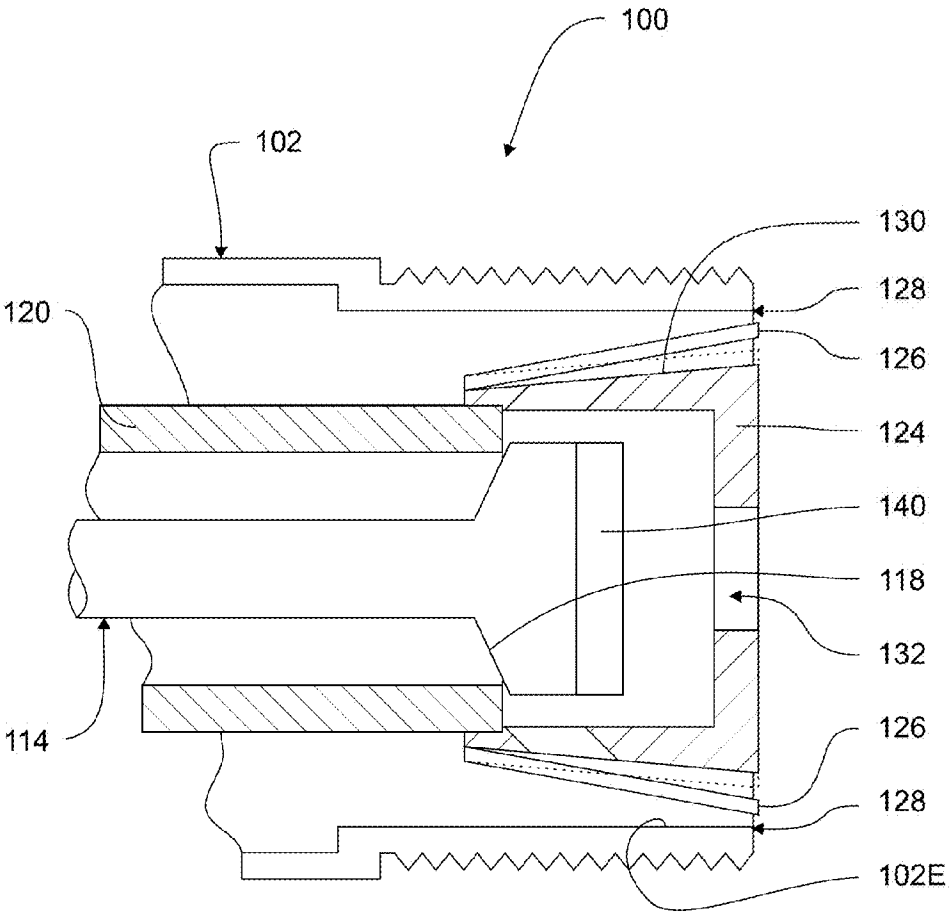
FIG. 3A is an enlarged partial cross-sectional side view of the injector-igniter shown in FIG. 1 illustrating the variable gap electrodes.

FIG. 3A is an enlarged partial cross section of injector-igniter 100 showing an embodiment including the electrode cage 124 and reed electrodes 126 in more detail. As disclosed above, injector-igniter 100 includes a valve seat 120 against which valve head 118 seals. Reed electrodes 126 may be rotated, displaced, or elastically deflected as a leaf-like spring from a region that is suitably attached such as to electrode 102 or 102E or to cage 124 or 130 at any chosen location to produce a one or more gap distances to or from electrode 102E or 302 at a variety of locations. Variations include starting with a minimum gap in the region around the seat of valve seat 320 as may be provided for a minimum gap from electrode 302 to 326 and include further variations according to the relative lengths on either side of a selected fulcrum location 342 (see FIG. 4A).

In an illustrative example, fuel flows along valve stem 114 and exits the valve seat 120 through suitable passageways or apertures such as slots, holes, or zones of porosity in electrode cage 124. Electrode cage 124 includes a plurality of apertures 130 and optional locations such as 132. Electrode reeds 126 may initially be spring biased closed against cage 124 or open at a suitably close distance to electrode 128. Apertures 130 and/or 132 allow fuel to flow from the end of the injector-igniter 100 into a combustion chamber (not shown). In this embodiment, the apertures 130 and/or 132 are in the form of slots 130 and a central opening 132 in the end of electrode cage 124. In some applications electrode cage 124 provides various openings and/or slots designed to impart a desired distribution and penetration pattern of fuel and/or fuel ions into the combustion chamber.

A plurality of reed electrodes 126 extend from the electrode cage 124 to form a plurality of corresponding functionally variable gaps 128 that may be of equal magnitude or of various selected magnitudes between the reed electrodes 126 and selected zones of housing 102 as shown at electrode 102E. An exemplary proximal end portion of the reed electrodes 126 are attached to the electrode cage 124 as shown. A distal end portion of the reed electrodes 126 is biased toward underlying cage 124 or towards the housing 102. The reed electrodes 126 may comprise a super alloy, copper based alloy, stainless steel, or spring steel which is bent or formed to maintain contact with the underlying surface of electrode 124 or a small gap at a chosen location to electrode 102E. In other embodiments, the reed electrodes may comprise a ferromagnetic material or include suitable permanent magnet poles. Reed electrodes 126 may be attached to the electrode cage 124 by any suitable attachment such as with welding or suitable fasteners. In some embodiments, reed electrodes 126 include varying (e.g., thinner or thicker) cross sections and/or other features in selected locations as needed to produce desired initial or deflected gaps and/or to respond to fluid forces and/or the force of magnet 140 to produce the desired rate and extent of electrode gap variation such as closing or widening and may be provided in one or more patterns to optimize outcomes for different engines or combustion chamber geometries such as opening directions and/or tuning of selected or alternating reeds to produce the desired low initial spark voltage and/or ion penetration pattern of fuel and/or oxidant ion projection into the combustion chamber.

In certain embodiments, valve head 118 includes a magnet 140 which is operative to move the reed electrodes 126 away from or toward the electrode cage 124 when the valve head opens, thereby decreasing or increasing the gaps 128. Accordingly, in certain embodiments, gaps 128 are relatively small at the initiation of ignition thereby requiring a relatively low voltage. However, at selected times such as when valve 114 is actuated towards the open position magnet 140 pulls the reed electrodes 126 closer to electrode cage 124, which increases the gap and provides a larger spark or continuing arc current population.

Figure 4B:
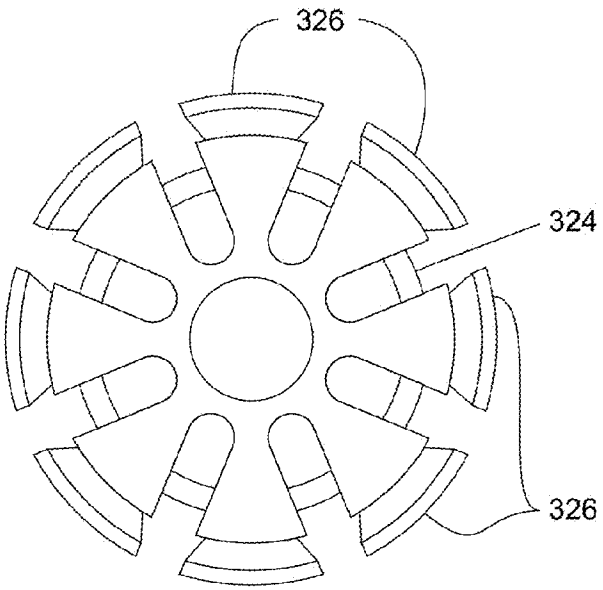
FIG. 4B is an end view of the electrode cage and reed electrodes shown in FIG. 4A.
Figure 4A:
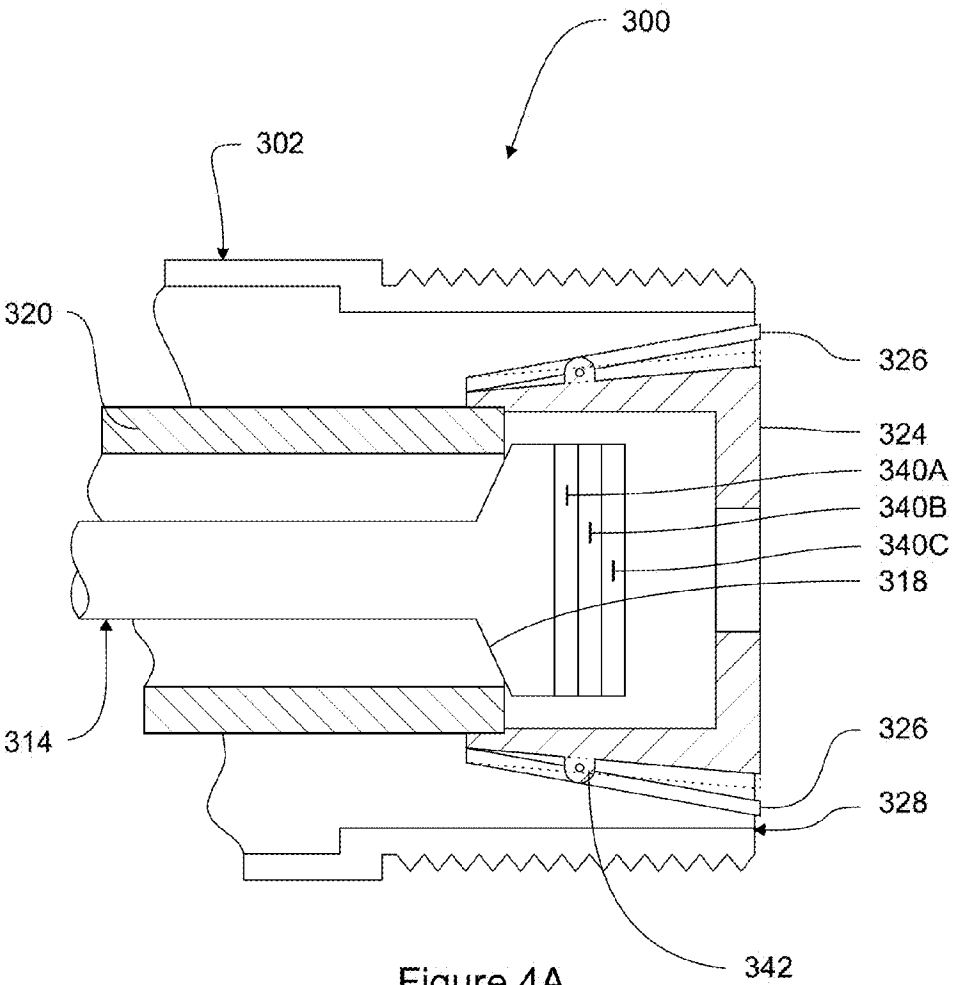
FIG. 4A is an enlarged partial cross-sectional side view of an injector-igniter having variable gap electrodes according to another representative embodiment.

FIGS. 4A and 4B illustrate an injector-igniter 300 having variable gap electrodes according to another representative embodiment. Injector-igniter 300 is similar to that described above with respect to FIGS. 3A and 3B, however in this case, the reed electrodes 326 are pivotably attached to electrode cage 324. Accordingly, injector-igniter 300 includes a valve seat 320 against which valve head 318 opens and closes. A plurality of reed electrodes 326 are pivotably attached at a selected fulcrum location to electrode cage 324 at hinges 342. Accordingly, as valve 314 is actuated, magnets, such as 340A, 340B, or 340C that act to push or pull the reed electrodes 326 away from and/or towards electrode cage 324 thereby decreasing or increasing the gap 328 including pushing then pulling then pushing and so forth as an operative result of the position of valve 314 and/or the net torque provided by magnets 340A, 340B, and 340C, the fuel pressure, and/or the combustion chamber pressure.

Figure 5B:
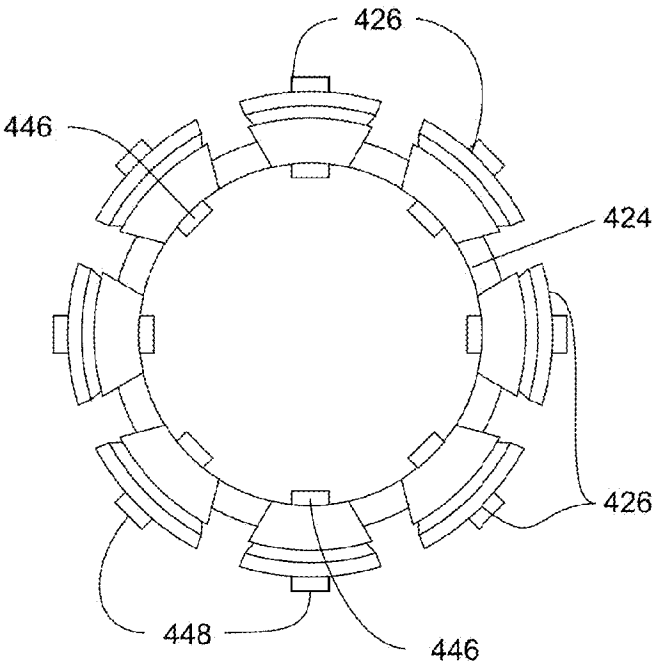
FIG. 5B is an end view of the electrode cage and reed electrodes shown in FIG. 5A.
Figure 5A:
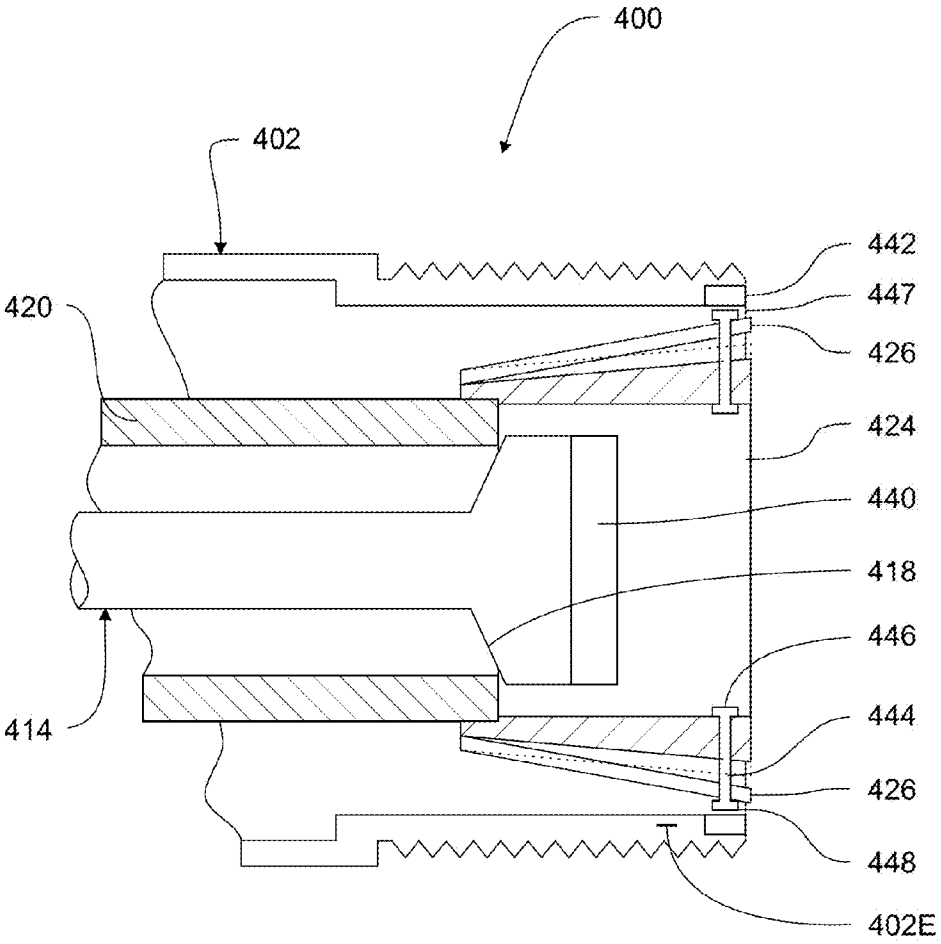
FIG. 5A is an enlarged partial cross-sectional side view of an injector-igniter having variable gap electrodes according to a further representative embodiment.

FIGS. 5A and 5B illustrate an injector-igniter 400 incorporating variable gap electrodes according to another representative embodiment. Injector-igniter 400 includes a housing 402 and a valve seat 420 against which valve head 418 opens and closes. In this embodiment, as valve 414 opens magnet 440 pushes or pulls on a plurality of electrode pins 444 any of which may contain or be a magnet. Electrode pins 444 extend through a suitable electrode cage 424 and through optional reed electrodes 426 which are present in some embodiments and not in others or that may be present on some pin locations and not others. Electrode pins 444 may include magnets 446 and 448 disposed on opposite ends of the electrode pin 444. Housing 402 in electrode zone 402E may also include a magnet or magnets 442 disposed around an inner perimeter to bias electrode pins 444 in an inward or outward position thereby minimizing gap 447. As valve head 418 moves towards electrode pins 444 magnet 440 increases or conversely overcomes the attractive force of magnets 442 thereby increasing the gap 447 to provide variations such as a larger spark or continuing arc current population.

Figure 6B:
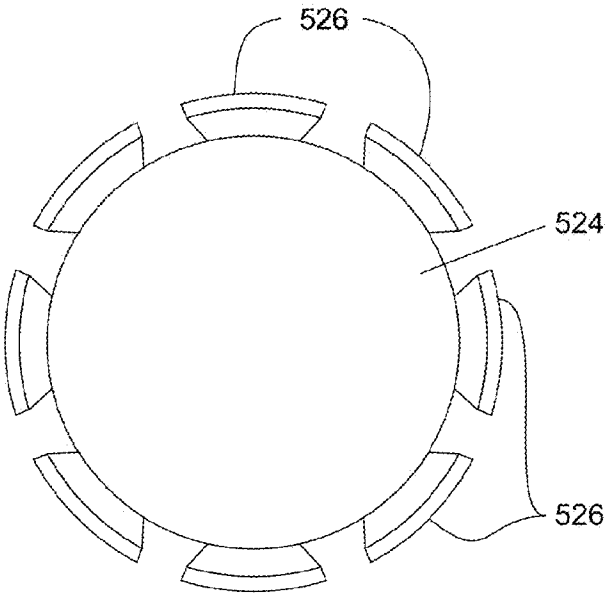
FIG. 6B is an end view of the electrode cage and reed electrodes shown in FIG. 6A.
Figure 6A:
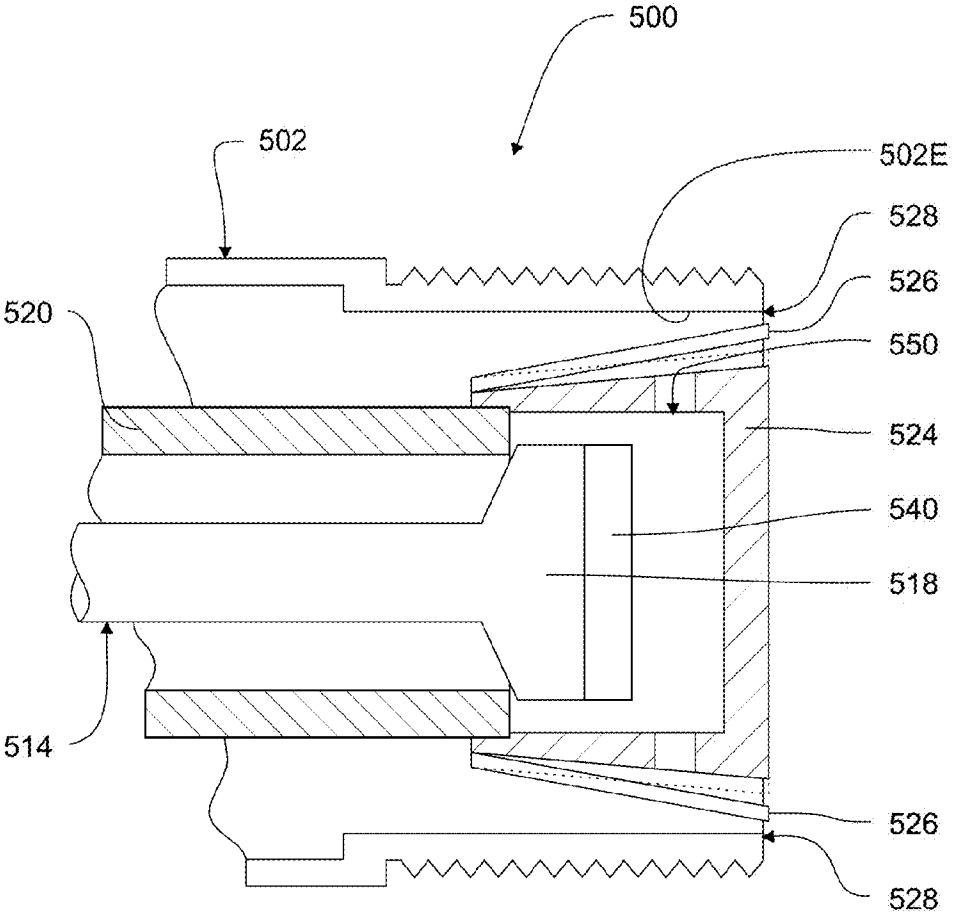
FIG. 6A is an enlarged partial cross-sectional side view of an injector-igniter having variable gap electrodes according to another representative embodiment.

FIGS. 6A and 6B illustrate an injector-igniter 500 having variable gap electrodes according to yet another representative embodiment. Injector-igniter 500 includes a housing 502 and a valve seat 520 against which valve head 518 opens and closes. In this embodiment, electrode cage 524 includes a plurality of radial apertures 550 through which fuel flows into a combustion chamber. Reed electrodes 526 are made of suitable heat and oxidation resistant materials and extend from electrode cage 524 and provide a gap 528 between reed electrodes 526 and housing 502 at housing electrode surface 502E. In this embodiment, each reed electrode 526 is positioned over a corresponding aperture 550. Furthermore, each reed electrode 526 is operative to cover its corresponding aperture 550 during times that there is minimal or no flow through one or more apertures 550 and/or combustion chamber events such as a combustion pressure wave event. Accordingly, fuel flow cools valve assembly 514-540 and cage 524 and when reed electrodes 526 cover apertures 550, valve head 518 as well as valve seat 520 are protected from the heat and particulate associated with combustion.

Figure 7:
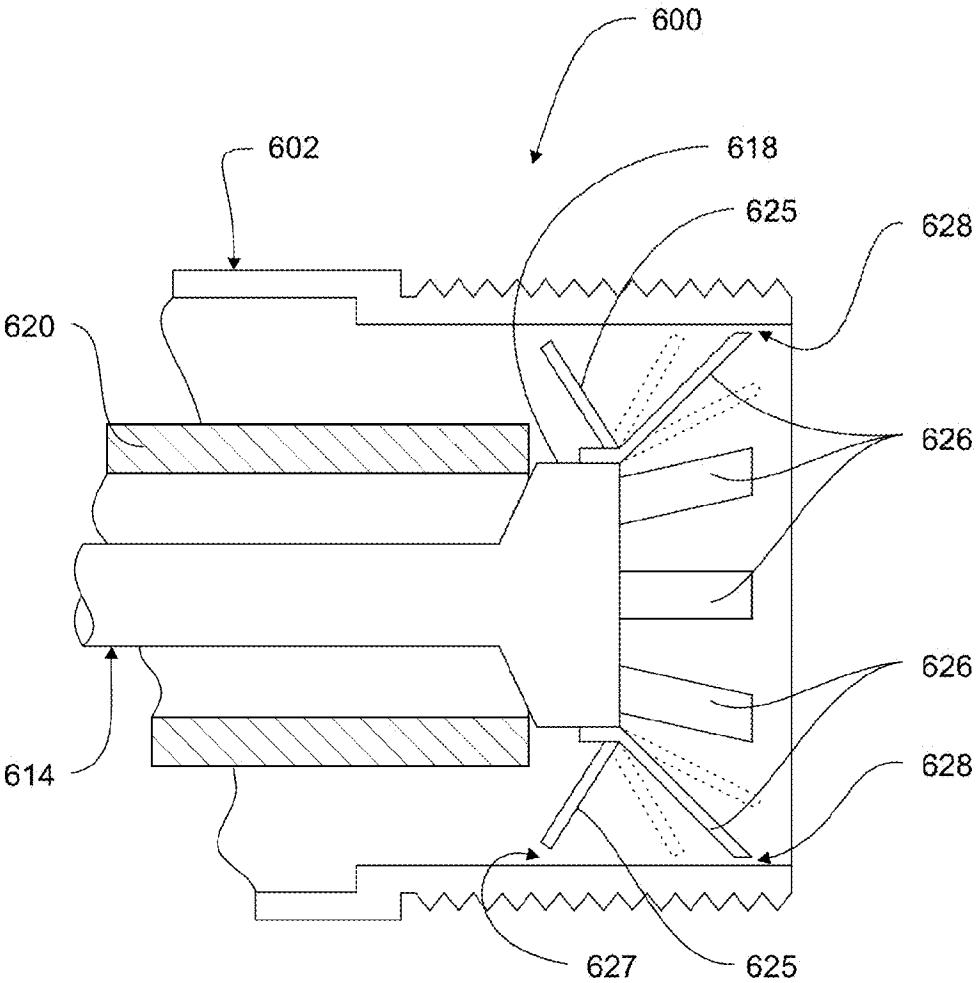
FIG. 7 is an enlarged partial cross-sectional side view of an injector-igniter having variable gap electrodes according to a still further representative embodiment.

FIG. 7 illustrates an injector-igniter 600 according to yet another representative embodiment. In this embodiment, injector-igniter 600 includes a housing 602 with a valve seat 620 against which valve head 618 opens and closes. In this case, when valve 614 is opened, fuel flows past valve head 618, around and through gaps 627 and/or 628 to produce suitable impedance to fluid flow. In this embodiment, the moveable spring electrodes 625, 626 extend from valve head 618 to provide variable gaps between the electrodes 625, 626 and housing 602. It can be appreciated from the figure that spring electrodes 625, 626 can be biased toward and/or away from electrode housing 602 such that when fuel flows past valve head 618 electrodes 625 and 626 deflect in desired ways and extents toward and/or away from housing 602 thereby decreasing or increasing the gaps 627 or 628 to require relatively small spark or continuing arc voltage and as the gap increases to produce larger arc current population as may be desired.

In operation this arrangement enables initial loading of the space around electrodes 625 and 626 with an oxidant such as air from the combustion chamber during intake and compression events of the engine. At selected times, such as when valve 614 starts to open, sufficient voltage is applied to initially ionize air and form a small current in gaps 627 and 628. Continued application of AC or DC voltage causes the ion current to rapidly build and thrust the ionized oxidant along with swept oxidant into the combustion chamber. As fuel particles arrive and fuel ions are developed in gap 627 the ion current multiplies as does the thrust from fuel pressure and as a result of very rapid combustion and electrical energy conversion.

Multiple fuel bursts and accelerations of ion currents can be provided as a result of multiple openings of valve 614 along with multiple sub-bursts produced by the frequency of voltage applications to produce Lorentz accelerations. Such operations may be managed by a suitable ECU to produce oxides of nitrogen and ozone that are launched as a stratified charge of highly activated oxidant within the combustion chamber. An example of a suitable engine control computer for such operations is described in co-pending U.S. patent application Ser. No. 13/843,976, entitled "CHEMICAL FUEL CONDITIONING AND ACTIVATION," and filed on Mar. 15, 2013, the disclosure of which is incorporated herein by reference in its entirety. Fuel and fuel ion particles enter the stratified charge of highly activated oxidant for accelerated initiation and completion of combustion consumption of such activated oxidant particles to assure complete elimination of such oxides of nitrogen and ozone after which additional fuel bursts are combusted within compressed air at an adaptively adjusted fuel delivery and heat release rate that avoids further production of oxides of nitrogen, ozone, or other objectionable emissions.

Figure 8:
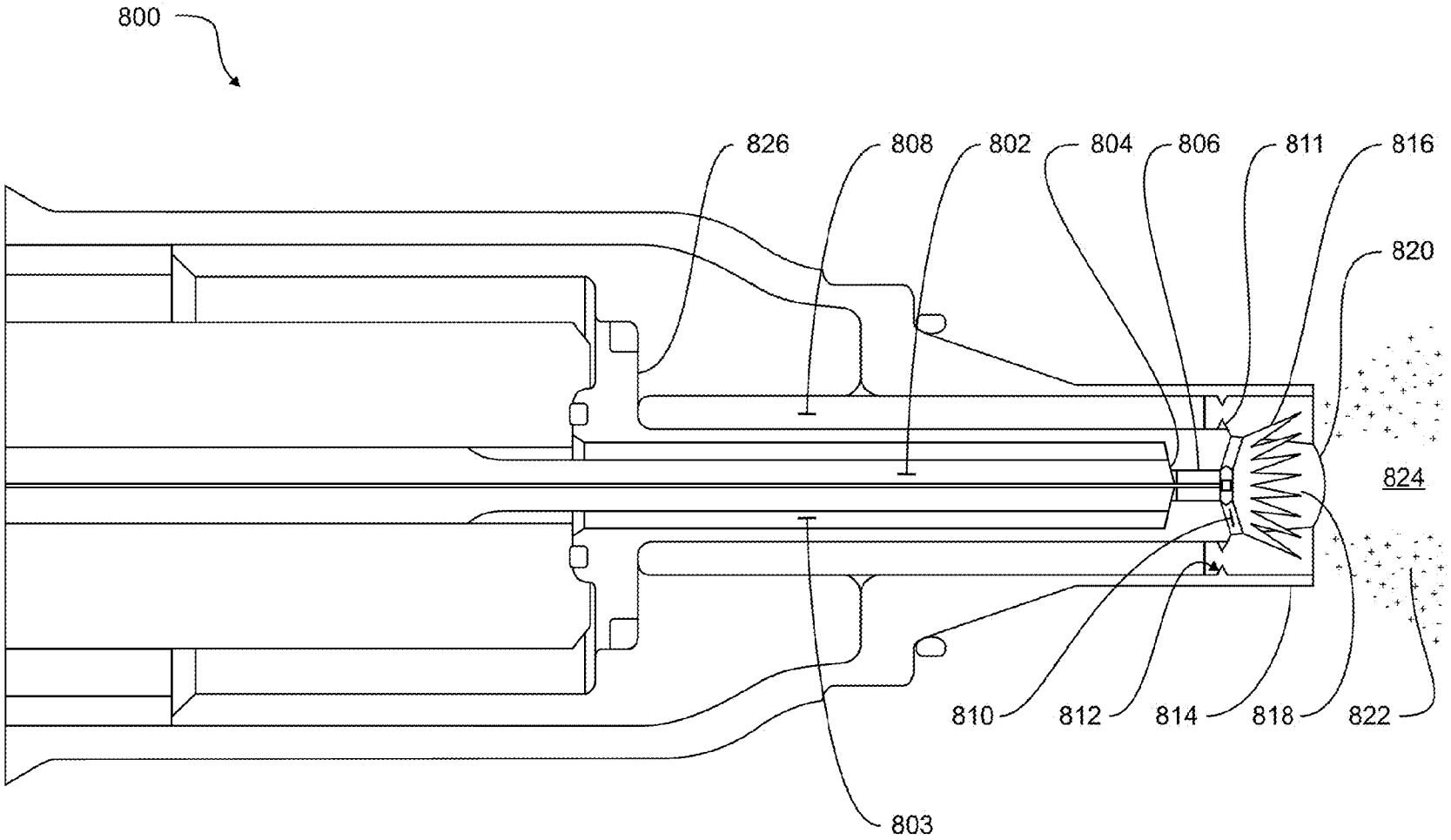
FIG. 8 is an enlarged partial cross-sectional side view of an injector-igniter having electrodes with a varying gap according to another representative embodiment.

FIG. 8 shows a cross-sectional view of a schematic showing at least some of the components of a system 800 combining fuel injection and ignition systems. In some embodiments of the system 800, pressurized fuel is routed to an inward opening flow control valve 802 that is retracted from stationary valve seat 804 by a valve actuator (not shown) to provide fuel flow from coaxial accumulator and passageway 803 and through conduit 806 to one or more intersecting ports 810. The valve actuator of the system 800 for actuation of fuel control valve 802 may include by any suitable system, e.g., including hydraulic, pneumatic, magnetostrictive, piezoelectric, magnetic or electromagnetic types of operations.

The system 800 includes a multi-electrode coaxial electrode subsystem including electrodes 811, 812, 814, 826, and 816 to ionize oxidants and/or air, as well as provide Lorentz thrust of such ionized fuel and/or oxidant particles. As shown in FIG. 8, the electrode 814 includes an outside diameter configured to fit within a port to combustion chamber 824, e.g., such as a port ordinarily provided for a diesel fuel injector in a diesel engine. In some embodiments, the electrode 814 can be structured as a tubular or cylindrical electrode, e.g., which can be configured to have a thin walled structure and interfaced with the port to the combustion chamber 824. For example, the electrode 814 can be configured with the electrode 826 as a coaxial electrode, in which an inner tubular or cylindrical electrode structure 826 is surrounded in an outer tubular or cylindrical shell structure 814. The coaxial electrode 814 and 826 can be structured to include ridges or points 812 and/or 811, respectively. The exemplary ridge or point features 811 and/or 812 of the coaxial electrode concentrate an applied electrical field and reduce the gap for production of an initial ion current, e.g., which can occur at a considerably reduced voltage, as compared to ordinary spark plug requirements in high compression engines. For example, approximately 30 kV across the electrode 811/812 on highest compression can be achieved, e.g., accomplishing combustion with a low gap and plasma, e.g., representing the highest boost diesel retrofit. In contrast, for example, in regular spark plug technology 80 kV is needed for combustion. It should be appreciated from the foregoing that the electrode gap varies from a narrow gap between points 811/812 to a relatively wide gap between 814 and 816 as the spark or accelerating plasma (produced by Lorentz thrusting) travels toward the combustion chamber 824. Thus, injector-igniter 800 incorporates variable gap electrodes.

Additionally, for example, the ridges or points 811 and/or 812 allow the electrode 814 to be substantially supported and/or shielded and protected by the surrounding material of the engine port through which the system 800 operates to avoid overheating and other degradation. The electrode 816 is configured within the annular region of the coaxial structure 814 and interfaced with the port to the combustion chamber 824. In some embodiments, for example, the electrode 816 is structured to include electrode antenna 818 at the distal end (interfaced with the port of the combustion chamber 824).

The system 800 includes a coaxial insulator tube 808 that is retained in place by axial constraint provided by the ridges or points 811 and/or 812 as shown, and/or other ridges or points not shown in the cross-sectional view of the schematic of FIG. 8. For example, engine cooling systems including air and liquid cooling systems provide for the material surrounding electrode 814 to be a beneficial heat sink to prevent overheating of electrode 814 or the voltage containment tube 808.

The system 800 includes a permanent magnet (not shown in FIG. 8) on the annular passageway of the valve and/or within or as integral parts of one or more antenna 818 to produce a magnetic field, that when utilized with the applied electric field, produces Lorentz acceleration on the ionized particles. In some embodiments, for example, the magnetic field can be operated to produce a Lorentz current having a torsional moment. For example, following such initiation, ion current is rapidly increased in response to rapidly reduced resistance and the growing ion current is accelerated toward the combustion chamber 824 by Lorentz force. The disclosed Lorentz thrust techniques can produce any included angle of entry pattern of ionized fuel and/or oxidants into the combustion chamber. For example, in an idling engine, the thrusted particles can be controlled to enter at a relatively small entry angle, whereas in an engine operating at full power, the thrusted particles can be controlled to enter with higher velocity in a relatively large angle for greatest air-utilization penetration into the combustion chamber (e.g., as widest included angles provide greater air utilization including fuel oxidation, expansive work production, and insulation of combustion products of such events with additional expansive work production to generate greater power in combustion). For example, the system 800 can enable utilization of excess air in the combustion chamber 824 to insulate the stratified charge combustion of fuel and to utilize heat in production of expansive work produced by combustion gases, e.g., before heat can be lost to piston, cylinder, or head, etc.

Lorentz thrusting of fuel and/or oxidant particles can be produced by application of sufficient electric field strength to initially produce a conductive ion current across the relatively smaller gap between electrode features, e.g., such as 811 and 812. The ion current interacts with the magnetic field to generate a Lorentz force on the ions of the ion current to thrust/accelerate the ions toward the combustion chamber 824, as shown by ions 822 in FIG. 8. The ion current population grows along with the Lorentz force as the electric field strength grows and/or the availability of particles between the electrodes. Application of such Lorentz thrust of ion currents may be during the intake and/or compression periods of engine operation to produce a stratified charge of activated oxidant particles, e.g., such as electrons, $O_3$, O, $OH^-$, CO, and $NO_x$ from constituents ordinarily present in air introduced from the combustion chamber, e.g., such as $N_2$, $O_2$, $H_2O$, and $CO_2$. Fuel may be introduced before, at, or after the piston reaches top dead center (TDC) to start the power stroke following one or more openings of the flow control valve 802. For example, fuel particles can be first accelerated by pressure drop from annular passageway 803 to the annular passageway between the coaxial electrode structure 814 and the electrode 816. The electrodes 816 and 814 ionize the fuel particles, e.g., with the same or opposite charge as the oxidant ions, to produce a current across the coaxial electrodes 814 and electrode 816. Lorentz acceleration may be controlled to launch the fuel ions and other particles that are swept along to be thrust into the combustion zone 824 at sufficient velocities to overtake or intersect the previously launched oxidant ions. For example, in instances that the fuel ions are the same charge as the oxidant ions (and are thus accelerated away from such like charges), the swept fuel particles that are not charged are ignited by the ionized oxidant particles and the ionized fuel particles penetrate deeper into compressed oxidant to be ignited and thus complete the combustion process. Lorentz thrusting is familiar to those of skill in the art and aspects of Lorentz thrusting is described further in U.S. Pat. Nos. 4,122,816 and 5,473,502, the disclosures of which are incorporated herein by reference in their entireties. To the extent the above incorporated patents and/or any other materials incorporated herein by reference conflict with the present disclosure, the present disclosure controls.

In some embodiments, a Lorentz (thrust pattern)-induced corona discharge may be applied to further expedite the completion of combustion processes. Corona ionization and radiation can be produced from electrode antenna such as 818 in an induced pattern presented by the Lorentz thrust ions 822 into the combustion chamber zone 824 (as shown in FIG. 8). Corona discharge may be produced from application of an electrical field potential at a rate or frequency that is too rapid to allow ion current or "spark" to occur between the electrode features 811 and 812 or the electrode 814 and the antenna such as 818. For example, one or more corona discharges that may be produced by the rapidly applied fields (e.g., in time spans ranging from a few nanoseconds to several tens of nanoseconds) are adequate to further expedite the completion of combustion processes, e.g., depending upon the combustion chamber pressure and chemical constituents present in such locations. Protection of the antenna 818 from oxidation or other degradation may be provided by a ceramic cap 820. For example, suitable materials for the cap 820 include, but are not limited to, quartz, sapphire, multicrystalline alumina, and stoichiometric or non-stoichiometric spinel, and/or as may be produced and thrust into the combustion chamber zone 824. Generation of corona bursts is known to those of skill in the art, examples of which are described in U.S. Pat. Nos. 3,149,620 and 4,514,712 and U.S. Patent Application Publication No. US201210180743, the disclosures of which are incorporated herein by reference in their entireties.

Figure 9A:
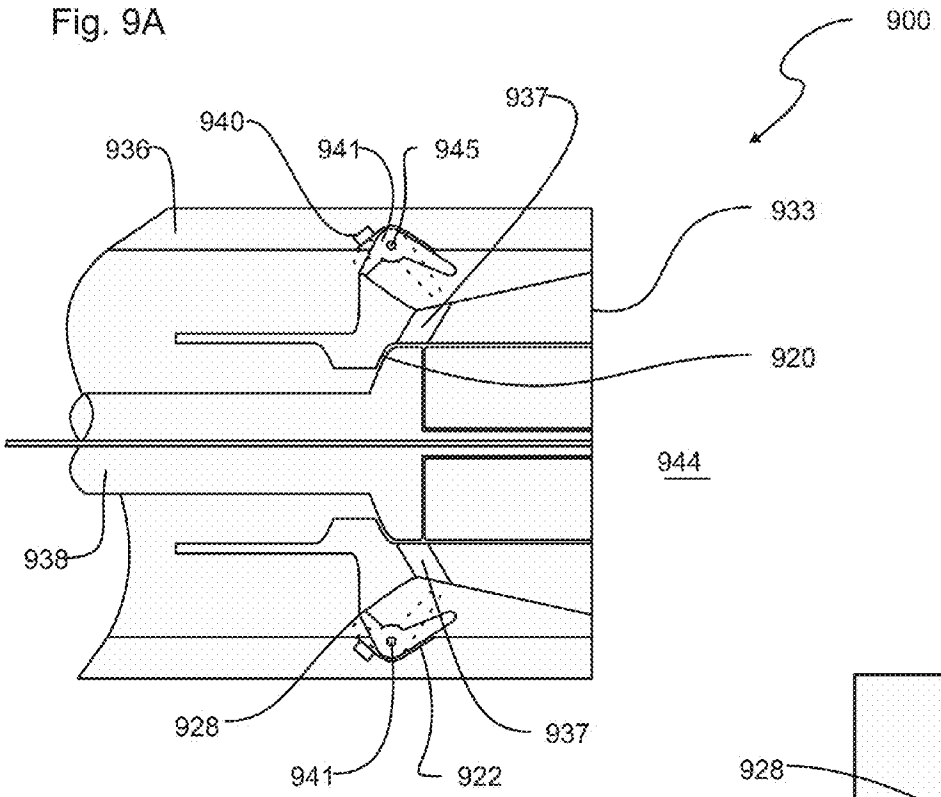
FIG. 9A is an enlarged partial cross-sectional side view of an injector-igniter having variable gap electrodes according to yet another representative embodiment.
Figure 9B:
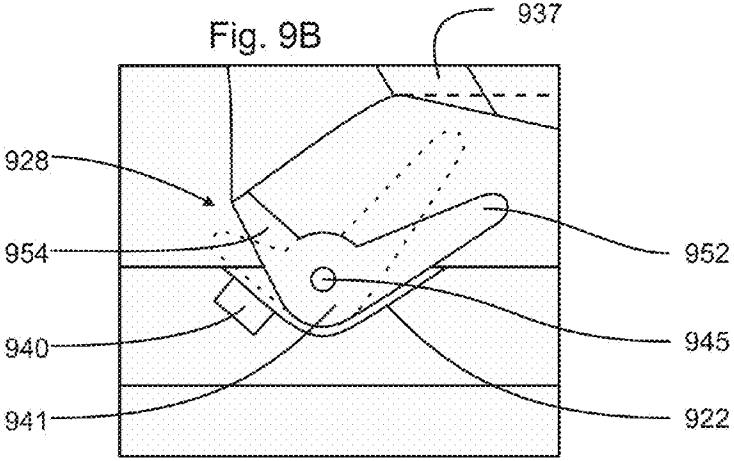
FIG. 9B is an enlarged partial cross-sectional side view the rocker electrode shown in FIG. 9A.

FIG. 9 illustrates an injector-igniter 900 having variable gap electrodes according to yet another representative embodiment. Injector-igniter 900 includes a housing 936 and a valve seat 920 against which valve 938 opens and closes. In this embodiment, valve seat electrode 933 includes a plurality of radial apertures 937 through which fuel flows into a combustion chamber 944. Moveable electrodes 941 are in the form of rockers that are elastically displaced or pivotably mounted in corresponding grooves, channels, or pockets 922 formed around the circumference of housing 936. The rocker electrodes 941 are made of suitable heat and oxidation resistant materials and are mounted to housing 936 with suitable bearing pins 945. Rockers 941 provide a gap 928 between electrodes arm 928 and valve seat electrode 933. In this embodiment, each rocker 941 also includes an arm 952 that sometimes extends in front of a corresponding aperture 937. Each or selected pockets include a magnet 940 which normally retains the rocker 941 in position to provide a relatively large gap. However, at selected times such as when fuel flows from valve 938, fuel accelerates through apertures 937 to impinge on arms 952, thereby rotating the rockers 941 to decrease the gap; thus, requiring relatively small spark or continuing arc voltage and as the gap increases to produce larger arc current population as may be desired.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Also contemplated herein are methods of varying electrode gaps. The methods may include any procedural step inherent in the structures described herein. Accordingly, the disclosure and associated technology can encompass other embodiments not expressly shown or described herein. The following examples provide additional embodiments of the present technology.

EXAMPLES

1. A fuel injector-igniter, comprising:

a housing;

an actuator disposed in the housing;

a valve including a valve head operative to open and close against a valve seat in response to activation of the actuator; and at least one movable electrode forming a variable gap between the electrode and a portion of the housing.

2. The fuel injector-igniter according to example 1, wherein the movable electrode extends from the valve head.

3. The fuel injector-igniter according to example 2, wherein a fuel flow past the valve head is operative to deflect the moveable electrode, thereby varying the gap.

4. The fuel injector-igniter according to example 1, wherein the moveable electrode is supported in the housing relative to the valve head.

5. The fuel injector-igniter according to example 4, wherein movement of the valve head causes the electrode to move, thereby varying the gap.

6. A fuel injector-igniter, comprising:

a housing;

an actuator disposed in the housing;

a valve including a valve head operative to open and close against a valve seat in response to activation of the actuator, wherein the valve head includes a magnet;

an electrode cage surrounding the valve head and including at least one aperture; and at least one reed electrode extending from the electrode cage to form a gap between the reed electrode and housing;

wherein the magnet is operative to move the at least one reed electrode toward the electrode cage when the valve head opens, thereby increasing the gap.

7. The fuel injector-igniter according to example 6, wherein a proximal end portion of the reed electrode is attached to the electrode cage.

8. The fuel injector-igniter according to example 7, wherein a distal end portion of the reed electrode is biased toward the housing.

9. The fuel injector-igniter according to example 8, wherein the reed electrode comprises spring steel.

10. The fuel injector-igniter according to example 7, wherein the at least one reed electrode is positioned over the at least one aperture and operative to cover the at least one aperture during a combustion event.

11. The fuel injector-igniter according to example 6, wherein the reed electrode is pivotably supported on the electrode cage.

12. The fuel injector-igniter according to example 6, wherein the magnet is a permanent magnet.

13. A fuel injector-igniter, comprising:

a housing;

an actuator disposed in the housing;

a valve including a valve head operative to open and close against a valve seat in response to activation of the actuator, wherein the valve head includes a magnet;

an electrode cage surrounding the valve head and including a plurality of apertures; and a plurality of reed electrodes, each extending from the electrode cage to form a gap between the reed electrode and housing, wherein each reed electrode is positioned over a corresponding aperture and operative to cover the aperture during a combustion event;

wherein the magnet is operative to move the reed electrodes toward the electrode cage when the valve head opens, thereby increasing the gaps.

14. The fuel injector-igniter according to example 13, wherein a proximal end portion of each of the reed electrodes is attached to the electrode cage.

15. The fuel injector-igniter according to example 14, wherein a distal end portion of each of the reed electrodes is biased toward the housing.

16. The fuel injector-igniter according to example 15, wherein the reed electrodes comprise spring steel.

17. The fuel injector-igniter according to example 13, wherein each reed electrode is pivotably supported on the electrode cage.

18. The fuel injector-igniter according to example 13, wherein the magnet is a permanent magnet.

19. The fuel injector-igniter according to example 13, wherein the reed electrodes comprise a ferromagnetic material.

20. A fuel injector-igniter, comprising:

a housing;

an actuator disposed in the housing;

a valve including a valve head operative to open and close against a valve seat in response to activation of the actuator; and at least one flexible reed electrode extending from the valve head to form a gap between the reed electrode and the housing;

wherein fuel flow past the valve head at least partially flows through the gap and is operative to deflect the reed electrode, thereby increasing the gap.

21. The fuel injector-igniter according to example 20, wherein the reed electrode is attached to the valve head.

22. The fuel injector-igniter according to example 20, further comprising a plurality of flexible reed electrodes attached to the valve head.

23. The fuel injector-igniter according to example 20, wherein a distal end portion of the reed electrode is biased toward the housing.

24. The fuel injector-igniter according to example 23, wherein the reed electrode comprises spring steel.

25. The fuel injector-igniter according to example 20, wherein the reed electrodes comprise a ferromagnetic material.

I claim:

1. A fuel injector-igniter, comprising:

a housing;

an actuator disposed in the housing;

a valve including a valve head operative to open and close against a valve seat in response to activation of the actuator; and at least one electrode pivotably mounted to the housing and forming a variable gap between the electrode and a portion of the valve seat;

wherein the electrode is positioned to move relative to the valve seat in response to a fuel flow past the valve head, thereby varying the gap.

2. The fuel injector-igniter according to claim 1, wherein the at least one electrode is in the form of a rocker including a pair of electrode arms.

3. The fuel injector-igniter according to claim 2, wherein the at least one rocker is mounted to the housing with a bearing pin.

4. The fuel injector-igniter according to claim 3, wherein the rocker is mounted in a pocket formed in the housing.

5. The fuel injector-igniter according to claim 4, further comprising a magnet disposed in the pocket and positioned to retain the rocker in a first position.

6. A fuel injector-igniter, comprising:

a housing;

an actuator disposed in the housing;

a valve including a valve head operative to open and close against a valve seat in response to activation of the actuator;

a valve seat electrode including at least one aperture and surrounding the valve head and valve seat; and at least one electrode pivotably mounted to the housing and forming a variable gap between the electrode and a portion of the valve seat electrode;

wherein the electrode is positioned to move relative to the valve seat electrode in response to a fuel flow through the at least one aperture, thereby varying the gap.

7. The fuel injector-igniter according to claim 6, wherein the at least one electrode is in the form of a rocker including a pair of electrode arms.

8. The fuel injector-igniter according to claim 7, wherein the at least one rocker is mounted to the housing with a bearing pin.

9. The fuel injector-igniter according to claim 8, wherein the at least one rocker is mounted in a pocket formed in the housing.

10. The fuel injector-igniter according to claim 9, further comprising a magnet disposed in the pocket and positioned to retain the at least one rocker in a first position.

11. The fuel injector-igniter according to claim 10, wherein the magnet is a permanent magnet.

12. The fuel injector-igniter according to claim 10, wherein the at least one rocker is positioned to move from the first position to a second position in response to the fuel flow.

13. A fuel injector-igniter, comprising:

a housing;

an actuator disposed in the housing;

a valve including a valve head operative to open and close against a valve seat in response to activation of the actuator;

a valve seat electrode surrounding the valve head and including a plurality of apertures; and a plurality of rocker electrodes, each pivotably mounted to the housing to form a gap between the rocker electrode and the valve seat electrode, wherein each rocker electrode is positioned over a corresponding aperture.

14. The fuel injector-igniter according to claim 13, wherein each rocker electrode includes a pair of electrode arms.

15. The fuel injector-igniter according to claim 13, wherein each rocker is mounted to the housing with a bearing pin.

16. The fuel injector-igniter according to claim 13, wherein each rocker is mounted in a pocket formed in the housing.

17. The fuel injector-igniter according to claim 16, further comprising a magnet disposed in the pocket and positioned to retain the rocker in a first position.

18. The fuel injector-igniter according to claim 17, wherein the magnet is a permanent magnet.

19. The fuel injector-igniter according to claim 17, wherein the rocker electrodes comprise a ferromagnetic material.

20. The fuel injector-igniter according to claim 17, wherein each rocker electrode is positioned to move from the first position to a second position in response to a fuel flow through the corresponding aperture.

* * * * *